United States Patent [19]

Milfs et al.

[11] Patent Number: 4,664,598

[45] Date of Patent: May 12, 1987

[54] UNITIZED QUICK-ASSEMBLY FAN

[75] Inventors: Wallace L. Milfs; Charles A. West, both of Greenville, S.C.

[73] Assignee: Reliance Electric Company, Greenville, S.C.

[21] Appl. No.: 658,158

[22] Filed: Oct. 5, 1984

[51] Int. Cl.[4] ..... F04D 29/40

[52] U.S. Cl. ..... 416/180; 416/185; 416/189; 416/247 R; 415/121 G

[58] Field of Search ..... 416/62, 181, 192, 247 R, 416/247 A, 189 R, 189 A, 180, 183, 184, 185, 188, 182; 415/121 G

[56] References Cited

U.S. PATENT DOCUMENTS

| | | | |
|---|---|---|---|
| 176,755 | 5/1876 | Murphy | 416/189 R |
| 1,467,227 | 9/1923 | Capell | 416/192 |
| 2,265,625 | 12/1941 | Buck | 416/62 |
| 2,443,411 | 6/1948 | Wolfe | 416/183 |
| 2,802,620 | 8/1957 | Darrah | 416/185 |
| 3,261,544 | 7/1966 | Guichard | 416/247 R |
| 3,521,973 | 7/1970 | Schouw | 416/185 |
| 3,927,952 | 12/1975 | Kirby | 416/181 |
| 4,417,855 | 11/1983 | Jepsen | 416/188 |
| 4,456,431 | 6/1984 | Crespin | 416/247 R |

FOREIGN PATENT DOCUMENTS

| | | | |
|---|---|---|---|
| 613517 | 1/1961 | Canada | 416/183 |
| 1628375 | 8/1970 | Fed. Rep. of Germany | 416/189 R |
| 833938 | 5/1960 | United Kingdom | 416/247 R |
| 849744 | 9/1960 | United Kingdom | 416/189 R |

*Primary Examiner*—Robert E. Garrett
*Assistant Examiner*—Joseph M. Pitko
*Attorney, Agent, or Firm*—Dority & Manning

[57] ABSTRACT

A cooling assembly including a fan blade subassembly for receipt about a drive shaft and a protective shroud secured to the fan blade subassembly for rotation therewith.

12 Claims, 5 Drawing Figures

UNITIZED QUICK-ASSEMBLY FAN

BACKGROUND OF THE INVENTION

The present invention relates to a cooling or circulating fan assembly in which assembly and disassembly of the component parts are easily accomplished, and which assembly minimizes the criticality of manufacturing tolerances of the various components.

Heretofore, cooling fans, particularly those utilized in industrial environs have included a fan blade that rotates with a shaft and with a stationary shroud received about the fan blade, secured by separate brackets to the housing from which the shaft protrudes. Assembly of such a fan requires drilling special holes in the housing for receipt of the shroud mounting brackets. The brackets are assembled and secured to the housing, after which the fan blade is secured on the shaft. Finally the fan shroud is secured to the brackets. While such fan arrangements have successfully cooled the equipment with which they have been employed, certain problems have existed in the assembly and disassembly of same.

Particularly, the shrouds and fan blades have often been cast metal parts which are not normally manufactured under close tolerance. It is thus often necessary in the assembly of the prior art fans to make adjustments between the fan blades and the shroud to avoid interference therebetween during rotation of the fan blades. More specifically, in situations where initial testing of a prior art fan assembly indicated physical interference between the rotating blades and the shroud, it was necessary, prior to final inspection and testing, to adjust the shroud relative to the fan blades such that contact therebetween is avoided. Not only has such an arrangement been ineffective due to the need for adjustment, obviously also, should either the blade or the shroud be adequately out of tolerance, the part would be scrapped.

As mentioned above, during assembly of prior art cooling fans, three basic component parts have historically been involved, namely mounting brackets, fan blades, and a shroud. Each of the three components must be maintained in inventory for replacement of worn and/or damaged parts. Should replacement be necessary, the new part, whether fan blade or shroud may not match the other. Adjustment or matching of both new components may then be necessary, either of which would be both expensive and time consuming.

The present invention is directed to a unitized, quick-assembly fan arrangement which overcomes the problems of the prior art. There is no need for adjustment to compensate for manufacturing tolerances since there is no relative rotation between the blades and the shroud. The mounting brackets are also eliminated. Further, and importantly, a single, unitized fan system is provided at the point of manufacture that may be maintained in inventory of the end user. If replacement is then needed, it is only necessary to secure an assembly to the drive shaft. Such arrangement is not known to be taught or suggested by the prior art.

SUMMARY OF THE INVENTION

It is an object of the present invention to provide an improved cooling fan assembly.

Another object of the present invention is to provide a cooling fan assembly that achieves enhanced air circulation.

Still further another object of the present invention is to provide a unitized cooling fan assembly for quick installation on a drive shaft for same.

Yet another object of the present invention is to provide an improved cooling fan assembly in which a shroud about a fan blade subassembly is secured thereto and rotates therewith.

Generally speaking the cooling fan assembly according to the present invention comprises a fan blade subassembly, said subassembly comprising a base adapted for securement to a drive shaft and a plurality of fan blades secured to said base and extending outwardly therefrom, said blades being aerodynamically shaped to achieve proper air displacement during rotation; and a shroud receivable about said fan blade subassembly and being secured thereto for rotation therewith, said shroud defining at least one opening therein located with respect to said fan blades such that during rotation of said fan assembly air will be displaced therethrough.

More specifically, the base of the blade subassembly is preferably generally circular in shape with a plurality of blade structures of unitary construction therewith and extending outwardly therefrom. The blade structures are preferably defined by cut-away, scalloped areas about the periphery of the base with contour of the cut-away sections affording proper shape to the blades. Furthermore, in a preferred arrangement, the fan blade base defines a central shaft receiving opening therethrough with at least one key slot defined in the periphery of same for securement of the fan assembly to a drive shaft. Furthermore, in a most preferred embodiment, the fan blade base is provided with at least one set screw or other locking means that extends radially therethrough into contact with the drive shaft to secure the fan assembly against axial displacement along the shaft.

The fan blade base is further preferably provided with a plurality of equidistantly spaced connector receiving openings extending thereinto in a direction generally parallel to the drive shaft receiving opening. The shroud, in turn, is provided with a matching number of openings through which connector elements may pass for rigid securement of the shroud to the fan blade subassembly.

The shroud for the present invention is intended to cover the fan blades and preclude inadvertent human contact therewith during fan operation. Preferably, the shroud includes a cover plate that extends totally across the area in front of the blades and which defines a shaft receiving opening, securement means receiving openings and at least one opening for air passage. A flange is also preferably secured about the perimeter of the cover plate and extends rearwardly therefrom to at least cover the outer free ends of the fan blades.

With the fan shroud secured to the fan blade subassembly, a single assembly is thus provided for the end user which requires no further adjustment. Single assembly installation may thus be achieved as opposed to multiple component installation as required with prior art structures. Economy is thus fostered by requiring less installation time, and by better inventory procedures.

BRIEF DESCRIPTION OF THE FIGURES

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
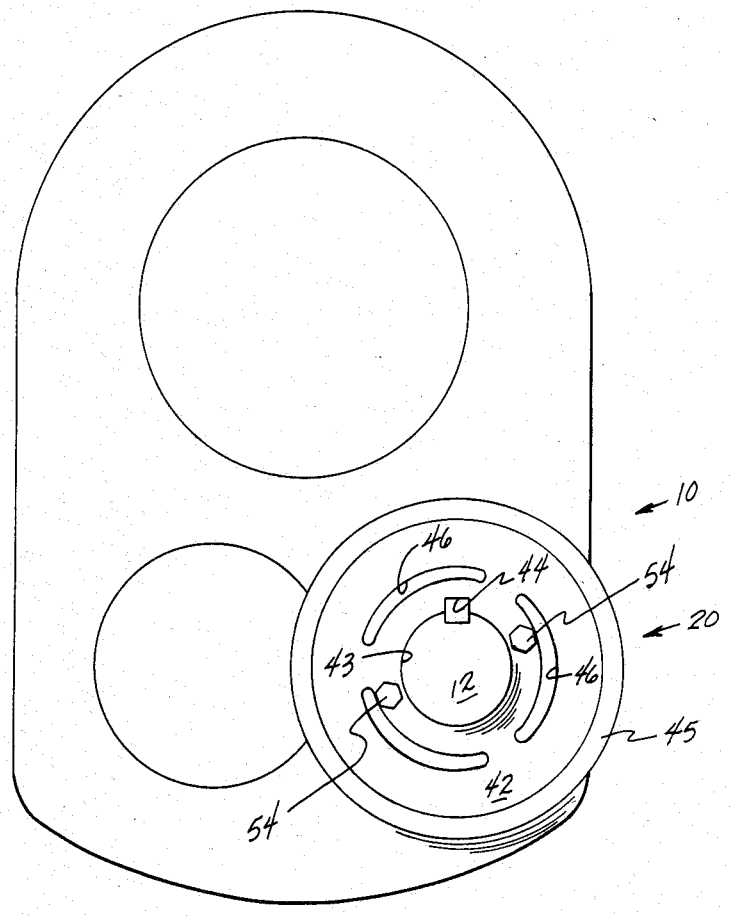
FIG. 1 is a schematic frontal elevational view of a torque arm speed reducer having a fan assembly of the present invention installed thereon.

Making reference to the figures, preferred embodiments of the present invention will now be described in detail. In FIG. 1 there is illustrated a torque-arm speed reducer generally 10 which is exemplary of equipment on which a cooling fan assembly of the present invention generally 20 may be employed. Heretofore it was necessary in installing a cooling fan on a drive shaft 12, to locate a fan blade assembly thereon after which a shroud of some description was installed by securing same to the housing. Hopefully thereafter, upon operation of the cooling fan, the fan blades would properly rotate within the shroud or cover without interference contact therewith. Even so, should a proper relationship exist, it was still necessary to properly install the individual components of the assembly and to maintain same separately in inventory. Such, however, has been overcome by the cooling fan assembly of the present invention in that a unitized assembly is initially provided which is maintained as such in inventory, and which may be simply and easily installed on a drive shaft without any fear of misalignment and/or improper sizing of the components in operation.

Figure 3:
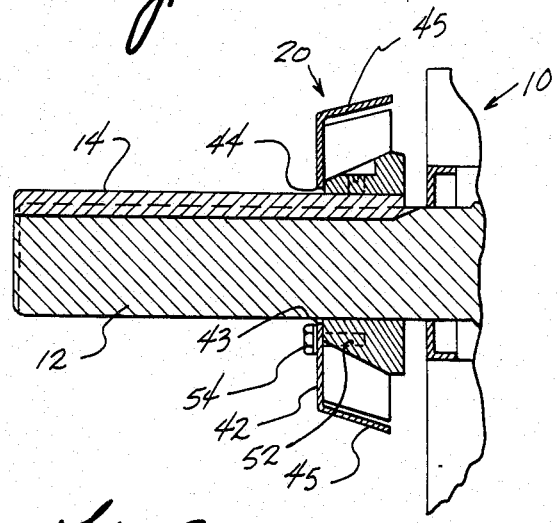
FIG. 3 is a vertical cross-sectiona view of the fan assembly taken along the line III—III of FIG. 2, and being illustrated mounted on a drive shaft.
Figure 4:
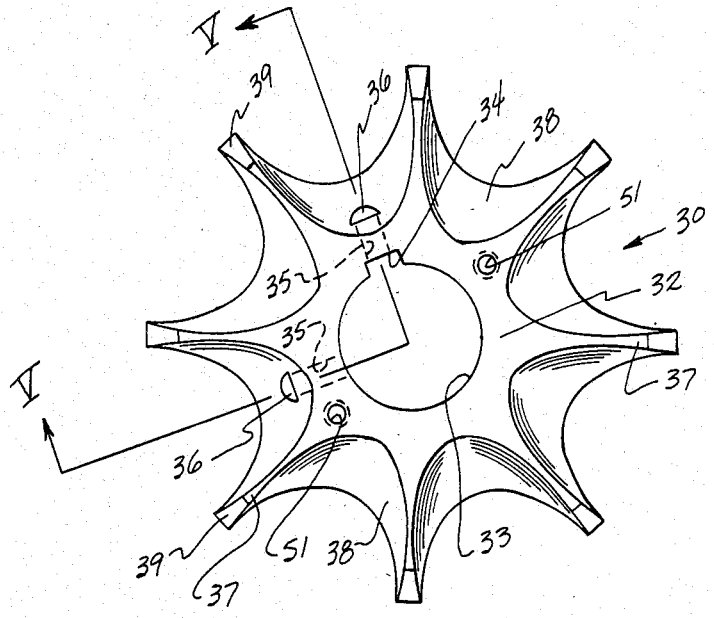
FIG. 4 is a frontal plan view of a fan blade subassembly according to the teachings of the present invention.
Figure 5:
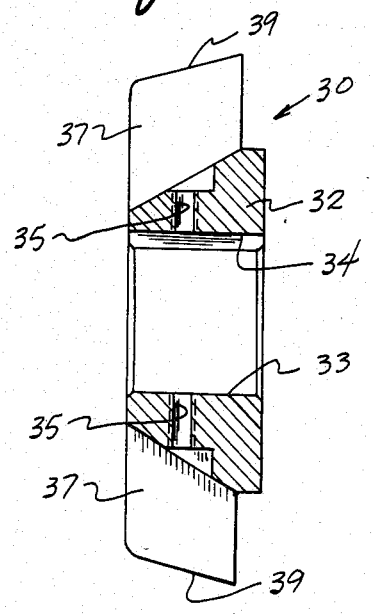
FIG. 5 is a sectional view of the fan blade subassembly as illustrated in FIG. 4 taken along line V—V.

As specifically illustrated in FIGS. 2–5, the cooling fan assembly generally 20 according to the teachings of the present invention includes a fan blade subassembly generally indicated as 30 (see FIGS. 4 and 5) to which a shroud generally indicated as 40 is secured for rotation therewith. Fan blade subassembly 30 includes a base 32 which defines a centrally located drive shaft receiving opening 33 therethrough. Drive shaft receiving opening 33 further includes a keyway 34 about a peripheral edge of same. Fan blade subassembly base 32 also preferably includes at least one locking means receiving opening 35 that is threaded and extends radially therethrough with respect to drive shaft receiving opening 33, into communication with same. A locking member 36 such as a set screw or the like, is threadably receivable within opening 35 and is movable into locking engagement with a portion of a drive shaft 12 received within drive shaft reoeiving opening 33 to lock the fan assembly on the shaft against axial movement with respect thereto. A plurality of fan blades 37 are secured to base 32 and extend outwardly therefrom. Preferably as shown in FIGS. 4 and 5, base 32 and fan blades 37 are of unitary construction with scalloped areas 38 being provided between adjacent fan blades 37. The contour of the scalloped areas 38 affords a taper along opposite sides of fan blades 37, extending from a rear side of the fan blade subassembly towards a forward side of the subassembly. Furthermore, fan blades 37 have a beveled outer edge at 39. A plurality of connector means receiving openings 51 are also provided in base 32 for securement of shroud 40 thereto.

In a preferred embodiment as illustrated in FIGS. 4 and 5, fan blade subassembly 30 as mentioned above, is manufactured of a single element such that the scalloped areas 38 located between adjacent fan blades 37 afford aerodynamic properties to the fan blades 37 for proper air displacement during rotation of same. Furthermore, as illustrated particularly in FIG. 4, eight fan blades 37 are provided, being equidistantly spaced about the outer periphery of base 32. Obviously a varied number of fan blades may be provided so long as the spacing of same about the fan blade subassembly is such that a balanced component results.

Shroud 40 which is to be secured to fan blade subassembly 30 preferably includes a cover plate 42 that is generally solid in nature and defines a centrally located drive shaft receiving opening 43 and a keyway 44 therethrough, both of which are in axial alignment with the shaft receiving opening 33 and keyway 34 of the fan blade subassembly 30. Cover plate 42 of shroud 40 further defines a like number of connector means receiving openings 52 as are provided in fan blade subassembly 30 and which are in alignment therewith for receipt of connector members 54 such as bolts or the like. Shroud 40 further includes a flange 45 that is secured around the outer periphery of cover plate 42 and extends rearwardly therefrom beyond outer beveled edges 39 of fan blades 37. In a most preferred embodiment as illustrated in FIG. 3, flange 45 of shroud 40 is spaced-apart from an outer edge of fan blades 37 to permit the displacement of air therebetween.

Figure 2:
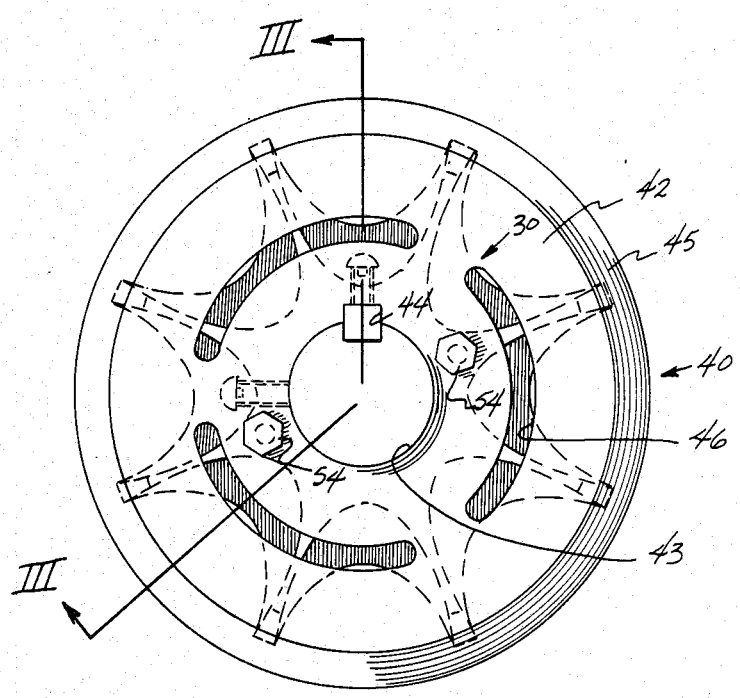
FIG. 2 is a front elevational view of a fan assembly according to the present invention.

Cover plate 42 additionally includes at least one air displacement opening 46 in front of blades 37 to permit the air displaced by fan blades 37 to exit therethrough. As illustrated in FIGS. 1 and 2, in a most preferred embodiment, three such air displacement openings 46 are provided in cover plate 42, with each opening 46 forming an arcuate segment around drive shaft receiving opening 43. From a standpoint of design, while it is important that cover plate 42 be adequately closed to afford safety protection against inadvertent human contact with rotating fan blades 37, the particular shape or number of the openings 46 in cover plate 42 may be varied as desired.

As is particularly illustrated in FIG. 2, shroud 40 has been secured to fan blade subassembly 30 by bolts 54 that extend through openings 52 of cover plate 42 and into threaded engagement with receiving openings 51 of subassembly base 32. With shroud 40 securely fixed to the fan blade subassembly 30, it is apparent from the figures that same may be received as a unit about a drive shaft 12 (see FIG. 3) with a key 14 associated therewith. Fan assembly 20 may thus be properly located for rotation with drive shaft 12 to perform its cooling function. As also illustrated in FIG. 2, a pair of locking, set screws 36 are received in openings 35 of base 32 and forwarded into locking engagement with drive shaft 12 to secure fan assembly 20 against axial movement with respect to drive shaft 12. In this fashion fan assembly 20 is adequately secured to drive shaft 12.

Fan assembly 20 according to the present invention, and as described above, does not present the problems of prior art assemblies. Particularly, the unit illustrated in FIG. 2 is fabricated and provided to an end user as shown. Thereafter, should it be necessary to install the assembly on a drive shaft either for original installation or replacement purposes, it is only necessary to bring assembly 20 onto shaft 12 with the key 14 being located in the respective keyways 34 and 44 after which the locking members 36 are secured against drive shaft 12 and/or key 14 as the case may be. A much simpler installation than was achievable by prior art structures is thus realized. Since shroud 40 rotates with fan blade subassembly 30, no interference problems therebetween can be present that can cause inconvenience and/or problems with use of the assembly.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A unitized cooling fan assembly including at least two separably engaged main elements, comprising:

(a) a generally planar fan blade subassembly, said fan blade subassembly comprising forward and rear sides separated by a given distance, a base extending inclusively between said sides and adapted for securement about a drive shaft, and a plurality of fan blades generally extending between said forward and rear sides, secured to said base and extending generally radially outwrdly therefrom, said blades being aerodynamically shaped to achieve air displacement during rotation thereof and including scalloped areas therebetween defining tapers from said rear to said forward side, and further including beveled outer edges on tips of said blades which are angled generally from said rear to said forward side and which define a conic section; and (b) a generlaly solid shroud receivable about said fan blade subassembly and being separably secured thereto for rotation therewith, said shroud providing protection from said fan blades during rotation of same and defining at least one opening therein located with respect to said fanblades such that during rotation of said assembly, air will be displaced therethrough, and said shroud further defining an angled flange about the periphery of a generally planar position thereof, which flange is disposed at such angle and position so as to be generally concentric with and slightly displaced from said conic section formed by said blade beveled outer edges, such displacement and angle thereof enhancing the passage of air between said flange and said outer edges during rotation of said assembly.

2. A cooling fan assembly as defined in claim 1 wherein said base and said fan blades are of unitary construction.

3. A cooling fan assembly as defined in claim 2 wherein said fan blades are equally spaced about a periphery of said base and are tapered on at least two edges thereof.

4. A cooling fan assembly as defined in claim 1 wherein said base of said fan blade subassembly defines a central shaft receiving opening therethrough, said shaft receiving opening having a keyway about a peripheral edge of same for securement of said assembly to said shaft, said base further having locking means received therein, said locking means being movable into and out of said shaft receiving opening for locking and removal of said assembly with respect to said drive shaft.

5. A cooling fan assembly as defined in claim 1 wherein said planar portion of said shroud includes a cover plate located forward of said fan blade subassembly, said cover plate defining a drive shaft receiving opening concentric to said drive shaft receiving opening through said base.

6. A cooling fan assembly as defined in claim 5 wherein said at least one opening of said shroud is defined by said cover plate.

7. A cooling fan assembly as defined in claim 6 wherein a plurality of air displacement openings are defined by said cover plate, said openings being arcuate in shape and being equidistantly spaced about said drive shaft receiving opening.

8. An assembly as in claim 1 wherein:

said base has a central shaft opening which is adapted for securement about said drive shaft; and said shroud defines an opening of generally same diameter as said central shaft opening and also adapted for securement about said drive shaft.

9. A unitized cooling fan assembly including at least two separably engaged main elements, comprising:

(a) a generally planar fan blade subassembly comprising a front surface and a rear surface separated by a distance, a base extending therebetween and defining a drive shaft receiving opening centrally therethrough, said base further defining at least one locking member receiving opening extending from an outer edge of same radially inwardly into communication with said drive shaft receiving opening, and a locking member received in said opening and being movable therein into and out of locking engagement; and a plurality of fan blades, generally extending between said forward and rear surfaces, being secured to said base and extending generally radially outwardly therefrom and equidistantly spaced therearound, said blades having scalloped areas therebetween defining tapers from said rear to said front surface, and further having beveled outer edges angled generally from said rear to said forward surface and defining a conic section; and (b) a shroud separably secured to said fan blade subassembly for rotation therewith, said shroud comprising a cover plate located adjacent a front surface of said base and said fan blades, said cover plate being generally solid and defining a drive shaft receiving opening centrally therethrough and of generally the same diameter as said base drive shaft receiving opening and defining at least one air displacement opening in front of said blades, and said shroud further defining an angled flange secured around an outer periphery of said cover plate and extending generally transversely outwardly therefrom concentric with and slightly displaced from said conic section defined by said beveled outer edges of said fan blades, whereby such position and displacement of said angled flanged permits the passage of air between said flange and said beveled outer edges during rotation of said assembly.

10. A cooling fan assembly as defined in claim 9 wherein said fan blades and said base are of unitary construction.

11. A cooling fan assembly as defined in claim 10 wherein:

said base and said cover plate define connector means receiving openings, and said assembly further comprises connector means, received in said openings, for securing said shroud to said fan blade subassembly.

12. A unitized cooling fan assembly including at least two separably engaged main elements, comprising:

(a) a generally planar fan blade subassembly having a front surface and a rear surface, a base between said surfaces and defining a drive shaft receiving opening centrally therethrough, said base further defining at least one locking member receiving opening extending from an outer edge of same radially inwardly into communication with said drive shaft receiving opening, a locking member received in said opening and being movable therein into and out of locking engagement; and a plurality of fan blades generally extending between said front and rear surfaces, being secured to said base generally extending outward therefrom and equidistantly spaced therearound, said blades having scalloped areas therebetween and being tapered along the length of same from said rear to said front surface, and said blades having beveled outer edges which are angled towards said forward surface and define a conic section; and (b) a shroud separably secured to said fan blade subassembly for rotation therewith, said shroud comprising a cover plate located adjacent a front surface of said base and said fan blades, said cover plate being generally solid and defining a drive shaft receiving opening centrally therethrough and of generally the same diameter as said base drive shaft receiving opening and defining at least one air displacement opening in front of said fan blades, and said shroud further defining an angled flange secured around an outer periphery of said cover plate and extending generally transversely outwardly therefrom concentric with and slightly displaced from said conic section defined by said beveled outer edges of said fan blades, whereby air is permitted to pass between said angled flange and said beveled outer edges during rotation of said assembly.

* * * * *